United States Patent [19]

Chabot et al.

[11] Patent Number: 5,028,000

[45] Date of Patent: Jul. 2, 1991

[54] PACKAGING TRAY WITH THERMOFORMED INNER LINING

[75] Inventors: Roland Chabot, Lussac; Philippe Dropsy, Talence, both of France

[73] Assignee: Societe Contentale Du Carton Ondule SOCAR, France

[21] Appl. No.: 490,720

[22] Filed: Mar. 8, 1990

[30] Foreign Application Priority Data

Mar. 9, 1989 [FR] France ..... 89 03112

[51] Int. Cl.[5] ..... B65D 5/42

[52] U.S. Cl. ..... 229/143; 229/150; 229/178; 229/191; 229/918

[58] Field of Search ..... 229/143, 150, 176, 178, 229/191, 918; 220/462

[56] References Cited

U.S. PATENT DOCUMENTS 2,822,119 2/1958 Van Dyke ..... 229/918
3,866,816 2/1975 Bemiss ..... 220/462
4,151,948 5/1979 de la Fuente, Jr. ..... 229/918
4,418,863 12/1983 Kimbrell, Sr. ..... 229/918
4,722,474 2/1988 Dropsy ..... 220/462

FOREIGN PATENT DOCUMENTS 3540005 1/1987 Fed. Rep. of Germany ..... 229/918

*Primary Examiner*—Gary E. Elkins
*Attorney, Agent, or Firm*—Scully, Scott, Murphy & Presser

[57] ABSTRACT

The invention disclosed herein relates to a packaging try with a thermoformed inner lining. The packaging tray includes, internally, in each corner, a corner panel which is inclined toward the bottom of the tray such that it approaches the center of the bottom. The corner panel is inclined at an obtuse angle with respect to the bottom and to the walls which define the corner. Also disclosed is a unitary packaging tray blank from which the packaging tray is constructed.

12 Claims, 3 Drawing Sheets

PACKAGING TRAY WITH THERMOFORMED INNER LINING

BACKGROUND OF THE INVENTION

The present invention relates to a packaging tray made of semi-rigid material, for example corrugated cardboard, the inner walls of which are intended to be lined, by thermoforming, with a film of thermoplastic material. Such trays are currently used for packaging moist foodstuffs in a modified gaseous atmosphere in order to preserve them.

An example of this type of tray is known from U.S. Pat. No. 4,722,474. This tray is of the type constructed from a blank, comprising a substantially rectangular bottom, on the sides of which there are articulated two longitudinal walls provided with turn-in panels intended to be folded down in order to double the longitudinal walls, and two transverse walls provided with entablatures intended to extend parallel to the bottom and toward the inside of the assembled tray. Once assembled, the tray is made impermeable by a protective film which is applied without discontinuity on its internal faces. In order to make such a lining, the tray is placed in the assembled condition inside a mold, then a strip of film made of thermoplastic material is arranged on top of the opening of the mold. A cover is pressed over the opening of the mold, the edges of the film strip then being applied against the top faces of the entablatures, the film is subsequently heated to bring it to its softening point, and is then blown or sucked toward the inside of the tray by the application of pressure.

The edges of the film thus adhere to the top faces of the entablatures, whereas its central part expands until it is applied against the bottom faces of the entablatures and against the side walls and the bottom of the tray. The tray is subsequently sealed by means of a leaktight cover made of thermoplastic material.

However, it has been found that the lining film made of thermoplastic material is subjected to considerable stretching especially in the corners formed by the walls and the bottom, and this increases the taller the tray. In these regions, the film undergoes a great deal of thinning and may well tear during or after the thermoforming. In the event of the film being ruptured, the gas within the tray escapes and the foodstuffs are no longer under a conditioned atmosphere. Moreover, the external moisture or that which results from the sweating of the foods may reach the cardboard through the holes and tears in the film, rapidly reducing its resistance to stacking.

SUMMARY OF THE INVENTION

The object of the present invention is to overcome these disadvantages and its subject is a packaging tray provided with means which make it possible to minimize the stretching of the thermoplastic film in the corners formed by the walls and the bottom.

The package according to the invention is of the abovementioned type and is characterized in that it includes internally, in the corners, corner panels which are inclined at an obtuse angle to the bottom such that they advance toward the center of the latter, and which are likewise inclined at an obtuse angle with respect to the bottom and to the longitudinal and transverse walls defining the corners.

Owing to the presence exclusively of obtuse angles in the corners, the thermoplastic film stretches less than in the case where the side walls are perpendicular to one another and to the bottom.

In the case of an externally rectangular tray, the corner panels are in the form of a triangle, one base of which lies on the bottom.

In the case where the tray is externally rectangular with corners in the form of a cant, the corner panels are in the form of a trapezoid, the large base of which rests on the bottom and the small base of which coincides with the top side of the cant.

Said corner panels may be constructed in one piece with the starting blank of the tray. To that end, each turn-in is continued at each of its two ends by a triangular or trapezoidal corner panel. The corner panels may themselves be continued by end flaps intended to lie on a transverse wall of the tray, thus locking the turn-ins and the corner panels.

BRIEF DESCRIPTION OF THE DRAWINGS

Two embodiments of packaging trays according to the invention will now be described by way of a nonlimiting example with reference to the accompanying drawings in which:

FIG. 4 is a partial perspective view of the same type of tray as that of FIG. 1, but in which the corner panels are added on.

DETAILED DESCRIPTION OF THE PREFERRED EMBODIMENTS

The description which follows will concern a packaging tray of rectangular shape provided with two entablatures but as will become evident, the invention is applicable to trays of any shape, for example triangular, square or polygonal, with or without entablatures.

Figure 1:
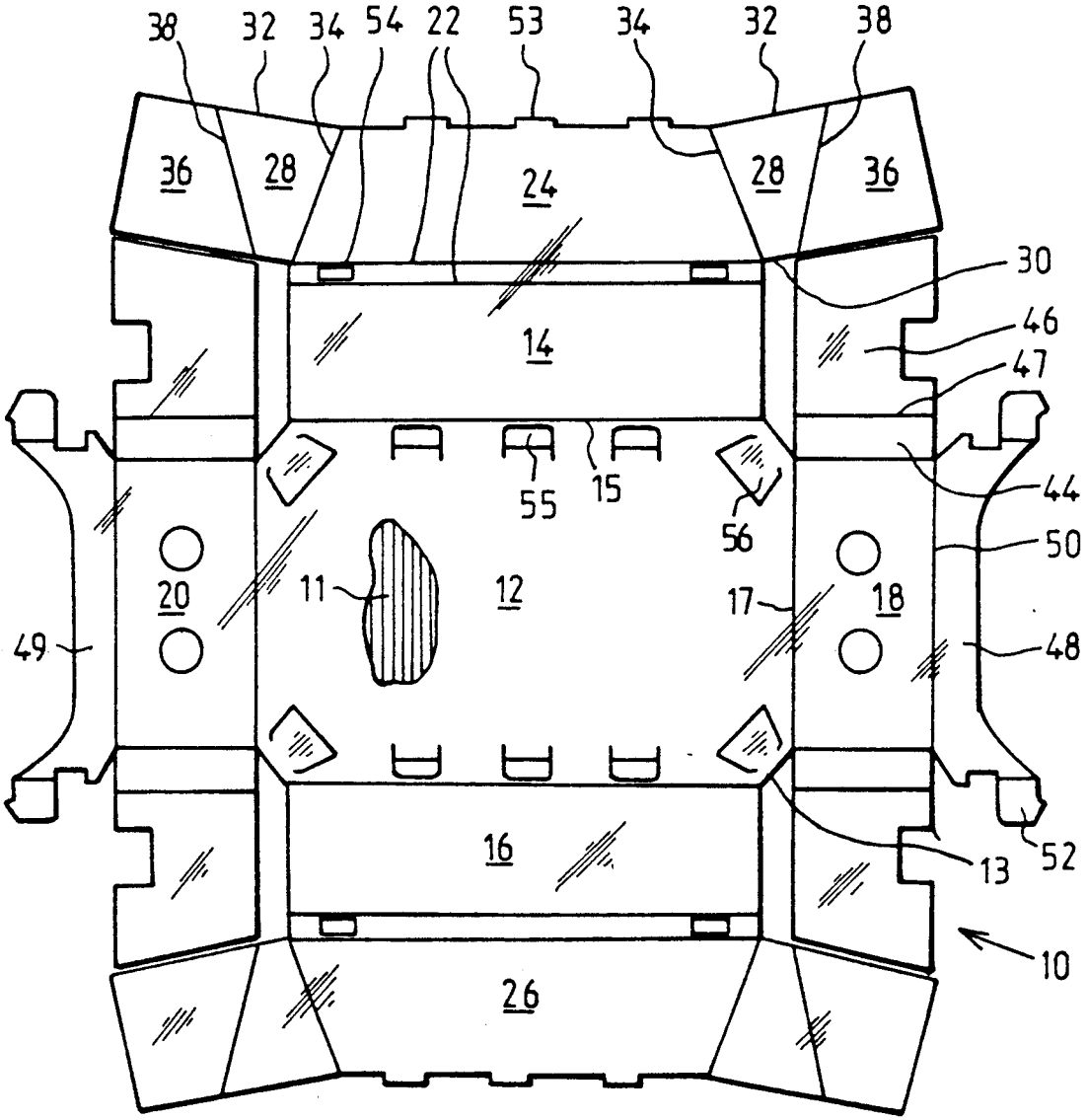
FIG. 1 shows a blank laid out flat, intended to construct a tray provided with trapezoidal corner panels in the case of a panel with truncated corners.

With reference to FIG. 1, the starting blank 10 is made of single- or double-thickness corrugated cardboard. It comprises a rectangular bottom 12 truncated at its corners 13 and on which there are articulated, by fold lines 15, 17, two longitudinal walls 14, 16 and two transverse walls 18, 20. The corrugations 11 of the cardboard are oriented parallel to the width of the bottom 12.

On the longitudinal walls there are articulated, by double folding lines 22, turn-ins 24, 26 intended to be folded over onto the longitudinal walls so as to form walls of double thickness.

Each turn-in, for example 24, is continued at its ends by foldable corner panels 28, of trapezoidal shape, the small base 30 and the large base 32 of which extend substantially in the longitudinal direction. The small base 30 is situated on the inner side of the corner panel and has substantially the same length as the corner 13.

The corner panels 28 are articulated on the turn-in by a fold line 34 and are themselves continued by end flaps 36 articulated on the corner panels by fold lines 38.

The transverse walls 18, 20 are continued at each of their ends by a foldable rectangular strip 44 which has substantially the same width as the truncated corner 13 and which is followed by an end flap 46 foldable along a line 47. The transverse walls carry along their longitudinal side entablatures 48, 49 foldable along fold lines 50. These entablatures are provided at their ends with locking tabs 52 intended to penetrate into slots 54 cut out between the double folding lines 22. The turn-in 24, 26 include, on their free edges, projections 53 capable of fitting into slots 55 cut out from the bottom, along the fold lines 15.

In order to make up the packaging tray, the transverse walls 18, 20 are firstly erected perpendicularly to the bottom 12. Thereafter, the longitudinal walls 14, 16 and their turn-ins 24, 26 are all erected perpendicularly to the bottom 12, and the turn-ins are then folded over onto the longitudinal walls, taking care to insert the end flaps 46 between the longitudinal walls 14, 16 and the turn-ins. The corner panels 28 are then situated in the corners defined by the longitudinal and transverse walls, while the end flaps 36 double the transverse walls internally. The entablatures 48, 49 are then folded to the horizontal and their locking tabs 52 are inserted in the slots 54.

Figure 2:
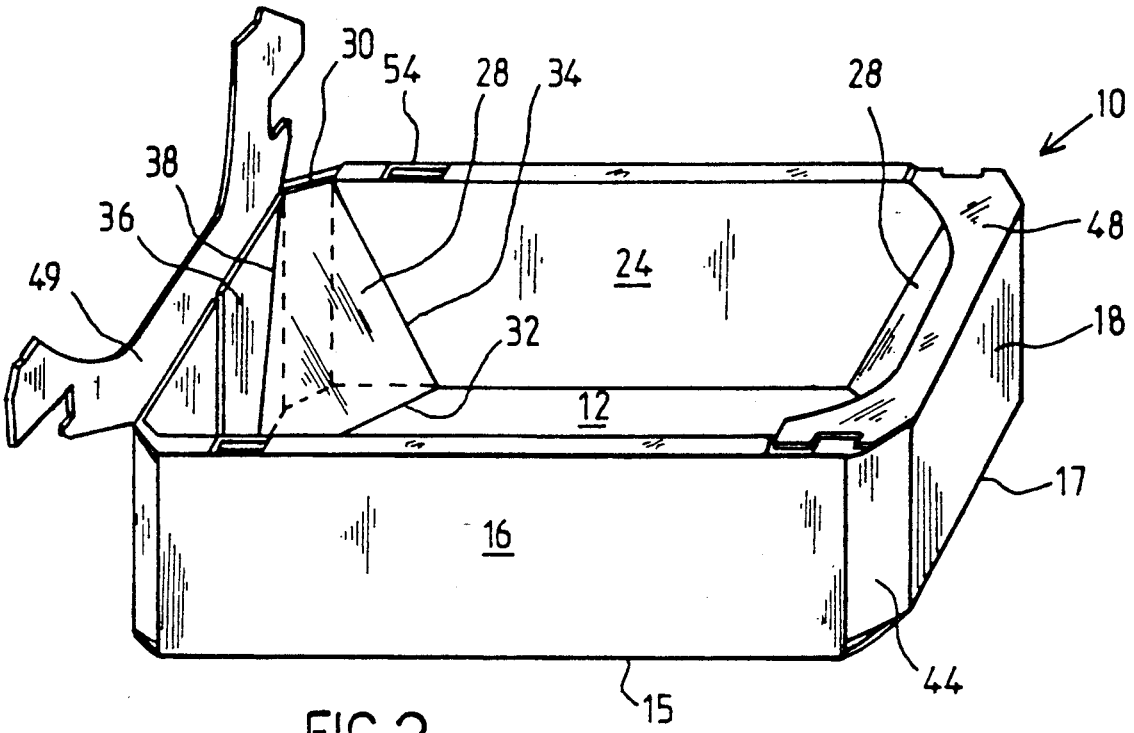
FIG. 2 shows, in perspective, the tray of FIG. 1 in the partially assembled condition.

It will be noted in FIG. 2 that the corner panels 28 are inclined from top to bottom such that they approach the center of the bottom 12 and form obtuse angles with the bottom, the longitudinal walls and the end flaps 36. The bottom corners of the tray, formed at the junction between the base 32 of the panel and the bottom 12, have therefore been brought considerably closer to the center of said bottom in comparison to the outer corners which have been illustrated in FIG. 2 in broken lines. The result of this is that during the thermoforming of a lining film made of thermoplastic material, said film will be stretched much less in the region of the bottom and in the bottom corners underneath the entablatures than it would have been if there were no corner panel. The risks of the film tearing are therefore virtually eliminated.

It is true that by constructing inclined corner panels, the resistance of the tray to stacking is sacrificed, in comparison to the case where the walls are vertical over the entire length of the tray, but there is a considerable gain in leaktightness Incised in the vicinity of the corners of the bottom 12 are tongues 56 which are capable of being raised with respect to the plane of the bottom in order to serve as stops for the corner panels. This raising is effected automatically in the mold employed to thermoform the packaging tray.

Figure 3:
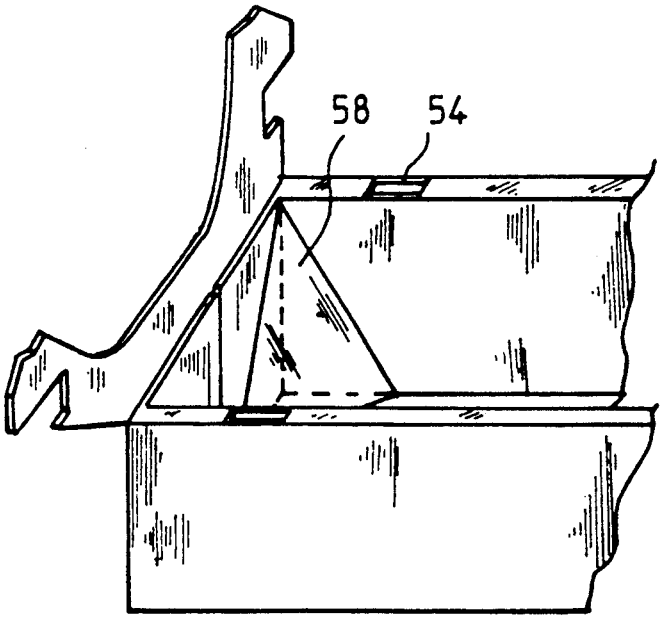
FIG. 3 is a partial perspective view of another tray embodiment with triangular corner panels in the case of a panel with non-truncated corners.

The packaging tray of FIG. 3 is distinguished from that of FIG. 2 in that its corners are not truncated. It includes therefore corner panels 58 of triangular shape. Here too, the stretching to which the coating film is subjected during the thermoforming will be considerably reduced in the corners of the tray.

Figure 4:
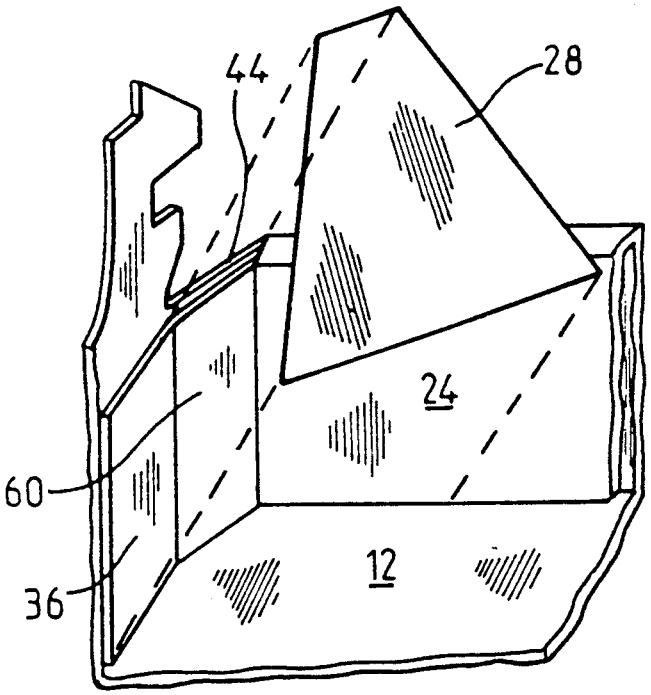

In the embodiment of FIG. 4, the panels 60, which occupy the same positions on the blank as did the corner panels, are now rectangular and lie exactly on the strips 44. The corner panels 28 a now consist of independent parts which are inserted in the corners of the tray and which are held in place either by means of wedging between the entablatures, the tab 56 and the side walls, or by means of adhesive bonding to these walls.

Similarly, the triangular corner panels of FIG. 3 may consist of independent add-on parts.

Naturally, the inner lining is thermoformed once the add-on corner panels have been put into place.

We claim:

1. A packaging tray comprising:

a substantially rectangular bottom panel having first and second lateral sides and first and second longitudinal sides;

first and second longitudinal walls respectively connected to the first and second longitudinal sides of the bottom panel, each longitudinal wall including (i) a main panel connected to and extending upward from the bottom panel, and (ii) a turn-in panel connected to the main panel of the longitudinal wall and folded thereover to form a double-thickness wall;

first and second transverse walls respectively connected to the first and second lateral sides of the bottom panel, each of the transverse walls including (i) a main panel connected to and extending upward from one of the lateral sides of the bottom panel, generally perpendicular thereto; and (ii) an entablature connected to the main panel of the transverse wall and extending inwardly therefrom over and generally parallel to the bottom panel of the tray;

wherein the first longitudinal and transverse walls form a first tray corner, and the second longitudinal and transverse walls form a second tray corner; and a plurality of corner panels, each corner panel being located adjacent a respective one of said corners and extending downwardly inwardly from said one corner over the bottom panel and toward a center thereof, and at an obtuse angle with the bottom panel, and inclined at an obtuse angle relative to each of the longitudinal and transverse walls forming said one corner.

2. A packaging tray according to claim 1, wherein:

each of the corner panels has the shape of a triangle, and includes a base edge and an apex;

the base edge of each of the corner panels lies on the bottom panel of the tray; and each of the first and second corners includes a top portion, and the apex of each of the corner panels coincides with the top portion of a respective one of the corners.

3. A packaging tray according to claim 2, wherein:

the bottom panel includes a plurality of truncated corners;

the tray further includes a plurality of rectangular strips, each of said strips extending upward from a respective one of the truncated corners of the bottom panel, and being located at a respective one of the tray corners;

each of the corner panels has the shape of a trapezoid, and includes large and small, parallel base edges;

the large base edge of each of the corner panels lies on the bottom of the tray; and each of the rectangular strips includes a top edge, and the small base edge of each of the corner panels coincides with the top edge of a respective one of the rectangular strips.

4. A packaging tray according to claims 1, 2, or 3, wherein the bottom, the first and second longitudinal walls, the first and second transverse walls, and the corner panels are all formed from one unitary blank.

5. A packaging tray according to claims 1, 2, or 3, wherein:

each of the turn-in panels includes first and second lateral edges;

each of the corner panels is connected to one of the lateral edges of one of the turn-in panels; and the tray further includes a plurality of end flaps, each of the end flaps being connected to a respective one of the corner panels and being held against a respective one of the transverse walls.

6. A packaging tray according to claims 1, 2, or 3 wherein the corner panels are formed from parts independent of the bottom, the first and second longitudinal walls, and the first and second transverse walls; and the corner panels are secured in the tray adjacent the tray corners.

7. A packaging tray according to claims 1, 2, or 3 wherein the bottom panel includes a plurality of lifted tongues serving as stops for the corner panels.

8. A unitary blank for forming a packaging tray, the blank comprising:

a substantially rectangular bottom panel portion having first and second lateral sides and first and second longitudinal sides;

first and second longitudinal wall portions respectively connected to the first and second longitudinal sides of the bottom panel portion and extending outward therefrom, each longitudinal wall portion including (i) a main panel connected to the bottom panel portion for folding movement relative thereto, and (ii) a turn-in panel connected to the main panel of the longitudinal wall portion for folding movement relative thereto to form a double-thickness wall with said main panel;

first and second transverse wall portions respectively connected to the first and second lateral sides of the bottom panel portion and extending outward therefrom, each of the transverse wall portions including (i) a main panel connected to one of the lateral sides of the bottom panel portion for folding movement relative thereto, and (ii) an entablature connected to the main panel of the transverse wall portion for folding movement relative thereto into a position extending over and generally parallel to the bottom panel portion of the tray;

wherein the first longitudinal and transverse wall portions are foldable connected to the bottom panel portion for movement into a position forming a first corner of the packaging tray, and the second longitudinal and transverse wall portions are foldably connected to the bottom panel portion for movement into a position forming a second corner of the packaging tray; and a plurality of corner panel portions, each of the corner panel portions being foldably connected to one of the wall portions of the blank for folding movement into a position adjacent a respective one of said corners and extending downwardly inwardly from said one corner over the bottom panel portion and toward a center thereof, and at an obtuse angle with the bottom panel portion and inclined at an obtuse angle relative to each of the longitudinal and transverse wall portions forming said one corner.

9. A blank according to claim 8, wherein:

each of the turn-in panels includes first and second lateral edges;

the plurality of corner panel portions includes first, second, third, and fourth corner panel portions; and each of the corner panel portions is connected to a respective one lateral edge of the turn-in panels.

10. A blank according to claim 9, wherein each of the corner panels has a triangular shape.

11. A blank according to claim 9, wherein:

the bottom panel portion includes a plurality of truncated corner edges;

each of the main panels of the transverse wall portions includes first and second lateral edges;

each of the transverse wall portions further includes first and second rectangular shaped sections respectively connected to and extending outward from the first and second lateral edges of the main panel of the transverse wall portion, each of the rectangular shaped sections being foldably connected to one of the main panels of the transverse wall portions for movement into a position extending upward from, and generally perpendicular to, a respective one of the truncated corner edges of the bottom panel portion; and each of the corner panel portions has the shape of a trapezoid.

12. A blank according to claim 8, wherein the bottom panel portion includes a base and a plurality of flexible tongues foldably connected to the base for movement into a stop position to limit folding movement of the corner panel portions.

* * * * *